US007865090B2

(12) United States Patent
Katoh

(10) Patent No.: US 7,865,090 B2
(45) Date of Patent: Jan. 4, 2011

(54) MAINTENANCE MANAGEMENT SYSTEM AND IMAGE FORMING APPARATUS

(75) Inventor: Eiichi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 238 days.

(21) Appl. No.: 12/124,650

(22) Filed: May 21, 2008

(65) Prior Publication Data

US 2008/0310864 A1 Dec. 18, 2008

(30) Foreign Application Priority Data

Jun. 14, 2007 (JP) ..... 2007-157617

(51) Int. Cl.
*G03G 15/00* (2006.01)

(52) U.S. Cl. ..... 399/24

(58) Field of Classification Search ..... 399/9, 399/24, 26, 111, 116
See application file for complete search history.

(56) References Cited

U.S. PATENT DOCUMENTS 5,873,009 A 2/1999 Yamashita et al.
6,137,966 A 10/2000 Uehara et al.
6,763,200 B2 * 7/2004 Sakai et al. ..... 399/27
7,509,062 B2 * 3/2009 Kikuchi et al. ..... 399/24
2002/0122673 A1 9/2002 Sakai et al.

FOREIGN PATENT DOCUMENTS

JP 2000-39815 2/2000
JP 2003-99550 4/2003

* cited by examiner

*Primary Examiner*—Hoan Tran
(74) *Attorney, Agent, or Firm*—Oblon, Spivak, McClelland, Maier & Neustadt, L.L.P.

(57) ABSTRACT

A disclosed maintenance management system includes an upper-limit information storage unit configured to store an upper limit of usage for each component identifier of a component, which upper limit is expressed by using an accumulated number of revolutions of a photoconductive drum in an image forming apparatus; a revolution number information acquiring unit configured to acquire a number of revolutions of the photoconductive drum used in the image forming apparatus; and an alarm output unit configured to calculate the accumulated number of revolutions of the used photoconductive drum, calculate a component service life predictive value by using the upper limit stored in the upper-limit information storage unit for each component identifier, and output an alarm including component information pertaining to the corresponding component identifier in the event that the component service life predictive value is less than or equal to a remainder day reference value.

9 Claims, 9 Drawing Sheets

MAINTENANCE MANAGEMENT SYSTEM AND IMAGE FORMING APPARATUS

BACKGROUND OF THE INVENTION

1. Field of the Invention

The present invention relates to a maintenance management system and an image forming apparatus for managing preventive maintenance (PM) performed by replacing components before failures occur, in order to maintain the performance of the image forming apparatus.

2. Description of the Related Art

Image forming apparatuses such as copiers require maintenance for maintaining performance. For example, for an image forming apparatus connected to a network, a remote monitoring server monitors abnormalities of the image forming apparatus. When this remote monitoring server detects an abnormality, a message reporting the abnormality is sent to a maintenance person such as a customer engineer (CE) so that maintenance is performed.

There is an image forming system with which the maintenance operation is simplified by holding usage frequency information of image forming apparatuses in a single image forming apparatus.

An image forming system for streamlining the maintenance operation for such image forming apparatuses is under consideration (for example, see patent document 1). Each image forming apparatus in the image forming system described in patent document 1 includes a copying unit, a network interface unit, and a usage cumulative counter unit. The number of copies processed by the copying unit is transferred, as copy number information, to the usage cumulative counter unit via the network interface unit. The usage cumulative counter unit adds the copy number information transferred via the network interface unit to a cumulative value that is currently held, and holds the resultant cumulative value. This cumulative value is then sent to another image forming apparatus so that the other image forming apparatus can hold the cumulative value. Accordingly, the maintenance operation can be simplified.

Furthermore, a replacement component order system is under consideration (for example, see patent document 2), for giving an instruction to the customer engineer to perform a maintenance operation based on a message reporting the abnormality from the image forming apparatus, and delivering replacement components to a predetermined location. The replacement component order system described in patent document 2 receives replacement component information pertaining to a component that needs to be replaced. Then, based on component management information including the replacement component information and the inventory status of the component, the replacement component order system sends, to a delivery company, delivery instruction information for delivering the component on a requested date. Upon receiving the message, the replacement component order system determines whether it is necessary to replace the abnormal component based on the abnormality. Based on the determination results, the replacement component order system sends replacement component information to a component management unit.

Patent Document 1: Japanese Laid-Open Patent Application No. 2000-39815 (page 1)

Patent Document 2: Japanese Laid-Open Patent Application No. 2003-99550 (page 1)

Preventive maintenance (PM) is often performed for obviating abnormalities in the image forming apparatus. Specifically, the customer engineer visits a customer and performs maintenance on an installed multifunction peripheral. Conventionally, as described in patent document 1, according to the number of copies formed by the image forming apparatus, the PM plan for the next month is created based on a predetermined PM reference copy number, a total counter acquired from the image forming apparatus, and an ACV (average copy value) obtained from past usage statuses. However, the service life of a component changes according to the usage status of the image forming apparatus. For example, the load on the image forming apparatus for outputting each sheet is different in the case of "1 to 1" output and "1 to N" output. In "1 to 1" output, one sheet is printed out for each job. In "1 to N" output, plural sheets are printed out around the same time for each job. Accordingly, the precision may be degraded if the PM reference determination is made based on a single number representing the number of copies.

Furthermore, the conventional logic of PM reference and PM planning is based on the logic for a monochrome machine. However, a color image forming apparatus includes plural drums (for example, four drums of YMCK), and therefore, the usage count for each drum cannot be acquired. For this reason, it is difficult to create an accurate PM plan.

SUMMARY OF THE INVENTION

The present invention provides a maintenance management system and an image forming apparatus in which one or more of the above-described disadvantages are eliminated.

A preferred embodiment of the present invention provides a maintenance management system and an image forming apparatus for accurately specifying the maintenance timing and efficiently replacing components.

An embodiment of the present invention provides a maintenance management system including an upper-limit information storage unit configured to store an upper limit of usage for each component identifier of a component, which upper limit is expressed by using an accumulated number of revolutions of a photoconductive drum in an image forming apparatus; a revolution number information acquiring unit configured to acquire a number of revolutions of the photoconductive drum used in the image forming apparatus; and an alarm output unit configured to calculate the accumulated number of revolutions of the used photoconductive drum, calculate a component service life predictive value by using the upper limit stored in the upper-limit information storage unit for each component identifier, and output an alarm including component information pertaining to the corresponding component identifier in the event that the component service life predictive value is less than or equal to a remainder day reference value.

An embodiment of the present invention provides an image forming apparatus including a photoconductive drum configured to form images; a detection unit configured to detect a number of revolutions of the photoconductive drum; an upper-limit information storage unit configured to store an upper limit of usage for each component identifier of a component, which upper limit is expressed by using an accumulated number of revolutions of the photoconductive drum in the image forming apparatus; and an alarm output unit configured to calculate the accumulated number of revolutions of the used photoconductive drum, calculate a component service life predictive value by using the upper limit stored in the upper-limit information storage unit for each component identifier, and output an alarm comprising component information pertaining to the corresponding component identifier in the event that the component service life predictive value is less than or equal to a remainder day reference value.

According to one embodiment of the present invention, a maintenance management system and an image forming apparatus are provided, in which the maintenance timing is accurately specified and components are efficiently replaced.

BRIEF DESCRIPTION OF THE DRAWINGS

Other objects, features and advantages of the present invention will become more apparent from the following detailed description when read in conjunction with the accompanying drawings, in which:

FIG. 4A illustrates data recorded in a device file data storage unit, FIG. 4B illustrates data recorded in an output history data storage unit, FIG. 4C illustrates data recorded in a PM plan data storage unit, and FIG. 4D illustrates data recorded in a PM replacement component master data storage unit;

FIG. 5A illustrates data recorded in a component master data storage unit, and FIG. 5B illustrates data recorded in a component order data storage unit;

DETAILED DESCRIPTION OF THE PREFERRED EMBODIMENTS

A description is given, with reference to FIGS. 1 through 8, of a maintenance management system and an image forming apparatus according to an embodiment of the present invention, with which replacement components are ordered for performing preventive maintenance (PM).

Figure 1:
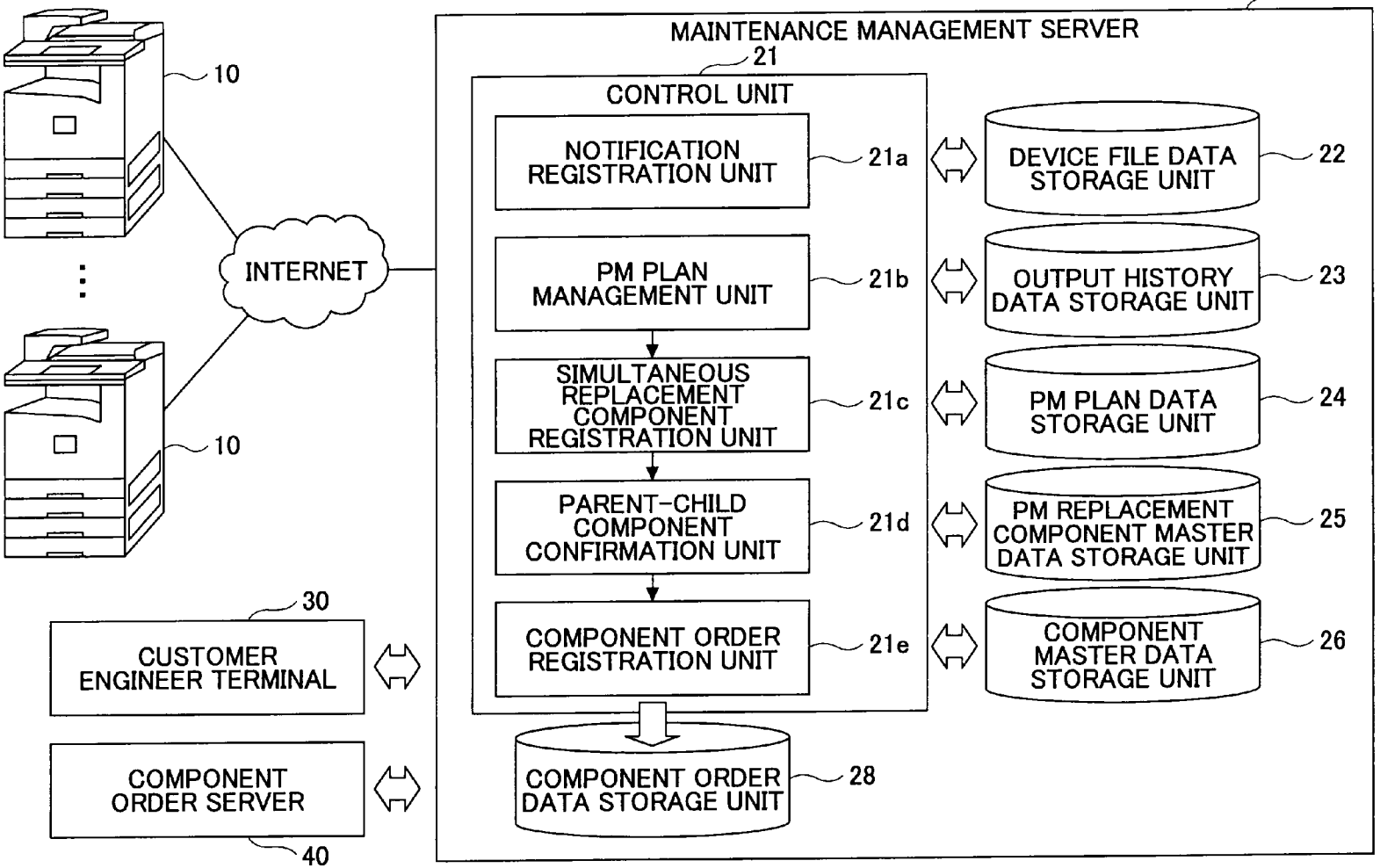
FIG. 1 is a schematic diagram of a system according to an embodiment of the present invention.

As shown in FIG. 1, a maintenance management system according to the present embodiment includes multifunction peripherals (MFP) 10 provided as image forming apparatuses and a maintenance management server 20 interconnected by the Internet as a network. Furthermore, a customer engineer terminal 30 and a component order server 40 are connected to the maintenance management server 20.

Figure 2:
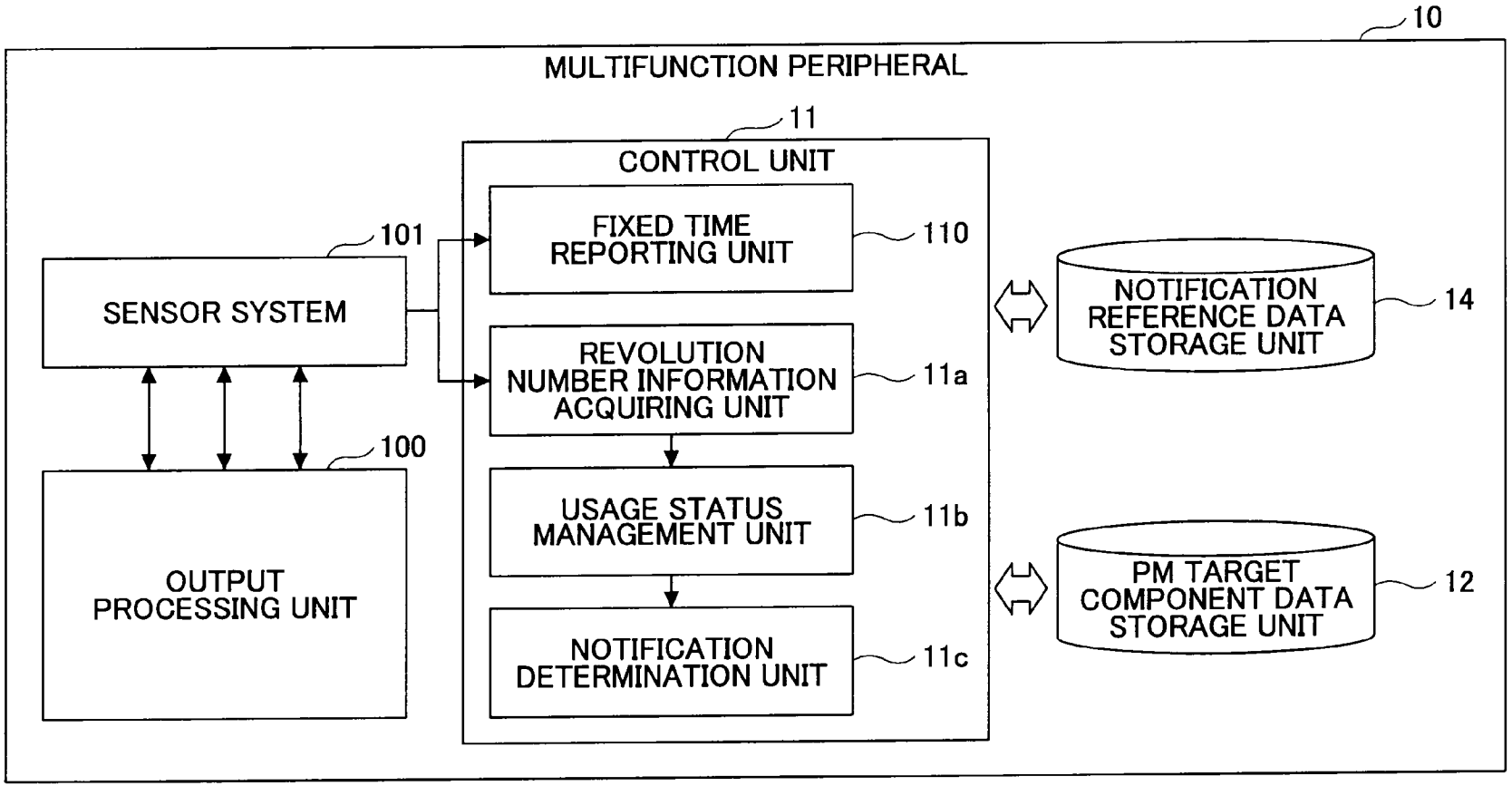
FIG. 2 is a functional block diagram of a multifunction peripheral.

Each of the MFPs 10 provided as the image forming apparatus functions as a printer, a scanner, a copier, and a facsimile machine. As shown in FIG. 2, each MFP 10 includes a control unit 11 including a control section (CPU) and storage sections (RAM, ROM, etc.), an output processing unit 100, and a sensor system 101.

The output processing unit 100 is for forming images, and includes a photoconductive drum, a charger, a laser scanner, a developing unit, a discharger, a transfer roller, a cleaner, a fixing unit, a sheet conveying unit, etc. The output processing unit 100 activates the charger to uniformly charge the surface of the photoconductive drum, activates the laser scanner to irradiate a laser beam onto the surface of the charged photoconductive drum and write an electrostatic latent image, and drives the developing unit to develop the formed electrostatic latent image with toner.

Furthermore, the output processing unit 100 drives the transfer roller to transfer the developed toner image onto a sheet, and drives the fixing unit to apply heat and pressure onto the sheet to fix the toner image onto the sheet. Furthermore, the discharger removes unnecessary charges from the surface of the photoconductive drum. The cleaner removes unnecessary toner remaining on the surface of the photoconductive drum, which has not been transferred onto the sheet.

The MFP 10 according to the present embodiment is a color machine, and includes four separate photoconductive drums for YMCK (yellow, magenta, cyan, and black).

The sensor system 101 is a detecting unit for detecting the operation status of each unit in the output processing unit 100. In the present embodiment, the sensor system 101 detects the number of revolutions of each photoconductive drum corresponding to one of the colors.

Furthermore, the control unit 11 acquires data to be printed and performs execution management of a printing process. Accordingly, the control unit 11 of the MFP 10 executes an information output processing program read from a program recording medium to execute processes of a fixed time reporting stage, a revolution number information acquiring stage, a usage status management stage, and a notification determination stage. The control unit 11 functions as a fixed time reporting unit 110, a revolution number information acquiring unit 11*a*, a usage status management unit 11*b*, and a notification determination unit 11*c*.

The fixed time reporting unit 110 periodically sends, to the maintenance management server 20, a fixed time report including usage status information recorded in a PM target component data storage unit 12. This fixed time report includes information pertaining to the usage length, a wear-out rate, and the remaining number of days for each component identification code.

The revolution number information acquiring unit 11*a* acquires, from the sensor system 101, information regarding the number of revolutions of each photoconductive drum.

The usage status management unit 11*b* calculates the accumulated number of revolutions of the photoconductive drums to calculate the usage length and the wear-out rate. The usage status management unit 11*b* determines whether it is necessary to send a parts alarm.

The notification determination unit 11*c* sends a parts alarm to the maintenance management server 20. The usage status management unit 11*b* and the notification determination unit 11*c* function as an alarm output unit. Furthermore, the MFP 10 includes the PM target component data storage unit 12 and a notification reference data storage unit 14.

Figure 3:
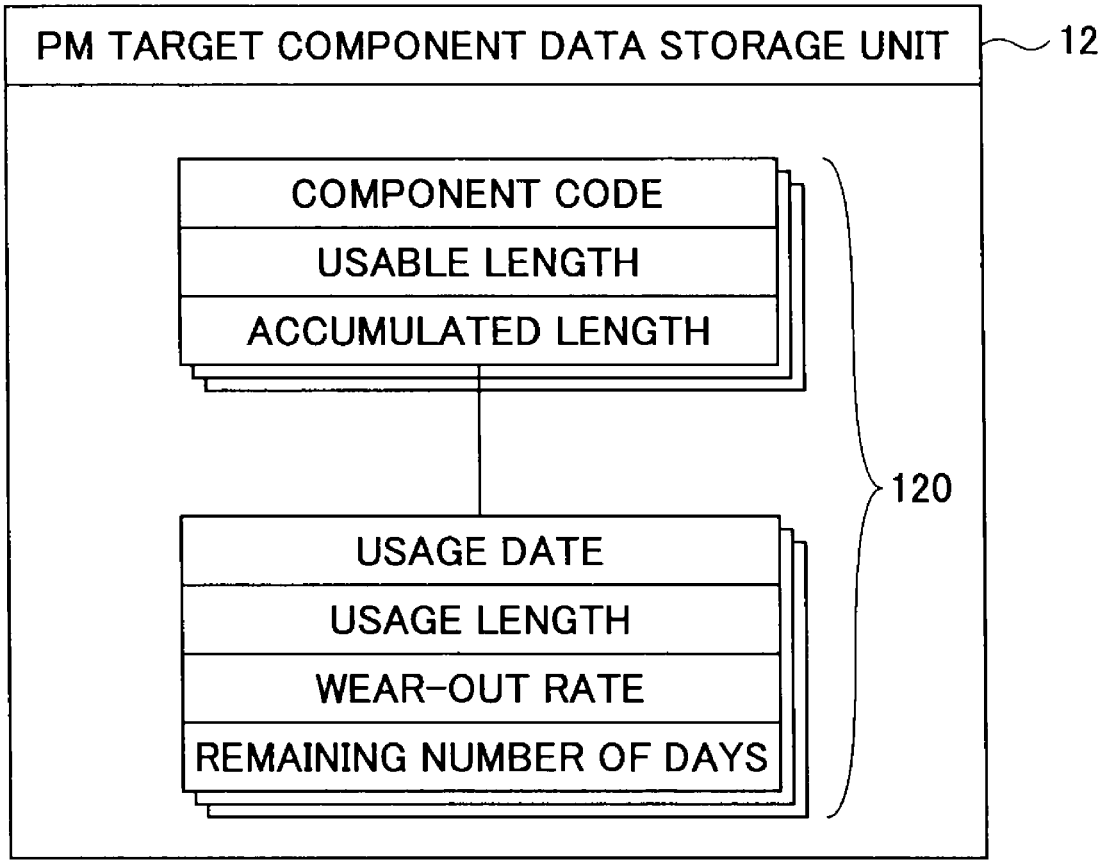
FIG. 3 illustrates data recorded in a PM target component data storage unit.

The PM target component data storage unit 12 functions as an upper-limit information storage unit and a wear-out rate reference information storage unit. As shown in FIG. 3, PM target component data 120 for managing the usage status of the PM target component of the MFP 10 are recorded in the PM target component data storage unit 12. The PM target component data 120 are updated every time a job is executed. The PM target component data 120 include data pertaining to component code, usable length, accumulated length, usage date, usage length, wear-out rate, and remaining number of days. Data pertaining to the accumulated length, the usage date, the usage length, the wear-out rate, and the remaining number of days are reset when the corresponding PM target component is replaced at the time of performing maintenance.

The component code data field includes data pertaining to a component identifier for identifying the PM target component in the MFP 10.

The usable length data field includes data pertaining to an upper-limit value indicating the upper limit to which the PM target component can be used. This upper-limit value is expressed by the accumulated number of drum revolutions (length).

The accumulated length data field includes data pertaining to the accumulated amount of using the PM target component. This accumulated amount is also expressed by the accumulated number of drum revolutions (length).

The usage date data field includes data pertaining to the date of executing the job.

The usage length data field includes data pertaining to the usage amount of using the PM target component on the usage date. This accumulated usage amount is also expressed by the accumulated number of drum revolutions (length).

The wear-out rate data field includes data pertaining to the proportion of wear out due to usage with respect to the upper-limit value indicating the upper limit to which the PM target component can be used.

The number of remaining days data field includes data pertaining to a predictive value of a remaining number of days until the PM target component is used up to the upper-limit value (component service life predictive value). The maintenance timing can be determined based on the number of remaining days.

The notification reference data storage unit 14 includes data pertaining to a reference for determining whether it is necessary to send a parts alarm. In the present embodiment, data pertaining to a reference number of days until an alarm are recorded, for comparison with the remaining number of days that the component can be used. Furthermore, the notification reference data storage unit 14 functions as a wear-out rate reference information storage unit, in which data pertaining to a reference wear-out rate are recorded for comparison with the wear-out rate of a component.

Meanwhile, the maintenance management server 20 is a computer server for generating a plan (action plan) for performing preventive maintenance for the MFP 10 used by a customer. As shown in FIG. 1, the maintenance management server 20 includes a control unit 21 including a control section (CPU) and storage sections (RAM, ROM, etc.). Furthermore, the maintenance management server 20 includes a device file data storage unit 22, an output history data storage unit 23, a PM plan data storage unit 24, a PM replacement component master data storage unit 25, a component master data storage unit 26, and a component order data storage unit 28.

The maintenance management server 20 functions as a maintenance management device, and executes a maintenance management program to perform processes described below (processes for a notification registration stage, a PM plan registration stage, a simultaneous replacement component registration stage, a component ordering stage, etc.). The control unit 21 functions as a notification registration unit 21*a*, a PM plan management unit 21*b*, a simultaneous replacement component registration unit 21*c*, a parent-child component confirmation unit 21*d*, and a component order registration unit 21*e*.

The notification registration unit 21*a* receives a fixed time report and a parts alarm from the MFP 10, and records this information in the output history data storage unit 23.

The PM plan management unit 21*b* functions as a maintenance plan management unit, and checks the maintenance plan recorded in the PM plan data storage unit 24 to determine whether it is necessary to additionally record a PM plan.

The simultaneous replacement component registration unit 21*c* checks the PM plan recorded in the maintenance plan recorded in the PM plan data storage unit 24 and calculates a component service life predictive value for another component. When a component service life predictive value of a component becomes less than or equal to an addition reference value, the corresponding component is additionally recorded as a simultaneous replacement component in the maintenance plan.

The parent-child component confirmation unit 21*d* identifies a parent-child relationship of components included in the maintenance plan. When a parent component and its child component are registered as maintenance target components, the component identifier of the child component is eliminated from the maintenance plan.

The component order registration unit 21*e* registers component information necessary for maintenance in the component order data storage unit 28.

Figure 4A:
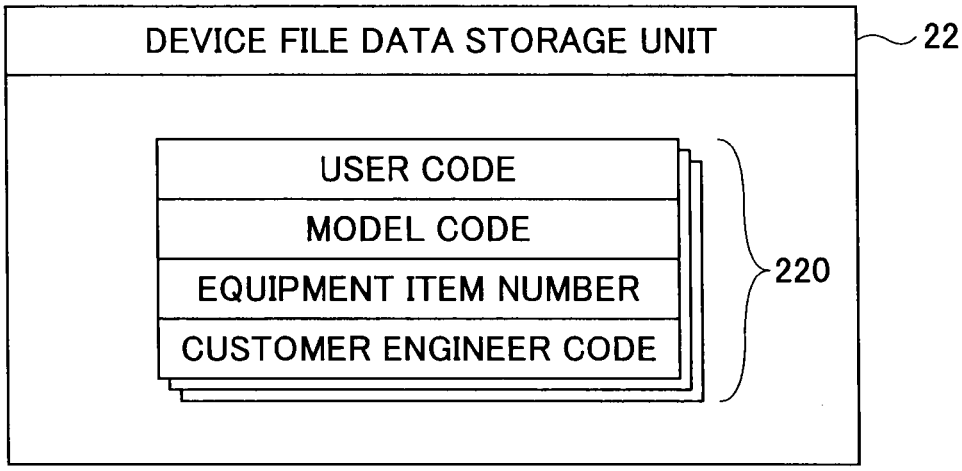
FIGS. 4A through 4D illustrate data storage units in a maintenance management server, where

As shown in FIG. 4A, the device file data storage unit 22 includes device file data 220 for managing the MFP 10 used by the customer.

The device file data 220 are registered when the customer starts using the MFP 10, and are updated every time new information is acquired. The device file data 220 include data pertaining to a user code, a model code, an equipment item number, and a customer engineer code.

The user code data field includes data pertaining to an identifier for identifying the customer using the MFP 10. By using this user code, it is possible to acquire, from a customer master data storage unit (not shown), information pertaining to the company and contact number of the customer as well as the location where the MFP 10 is installed.

The model code data field and the equipment item number data field include data pertaining to an identifier for identifying the model and the equipment item number (maintenance target device identifier) of the MFP 10 used by the customer.

The customer engineer code data field includes data pertaining to an identifier for identifying the customer engineer in charge of the corresponding customer account.

Figure 4B:
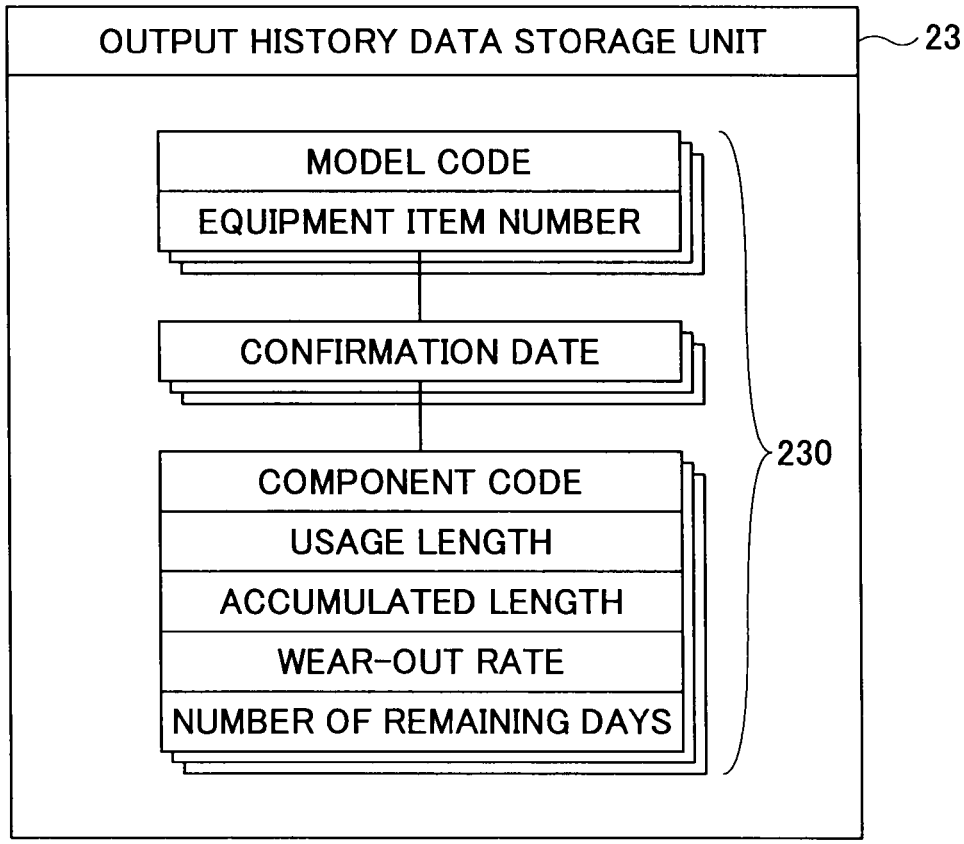

As shown in FIG. 4B, the output history data storage unit 23 includes output history data 230 for identifying usage history of each MFP 10. The output history data 230 are stored when the notification registration unit 21*a* receives a fixed time report and a parts alarm from the MFP 10. The output history data 230 include data pertaining to a component code, a usage length, an accumulated length, a wear-out rate, and a number of remaining days for each confirmation date with respect to a model code and an equipment item number. Data pertaining to a usage length, an accumulated length, a wear-out rate, and a number of remaining days are reset when the PM target component is replaced in the maintenance operation.

The model code data field and the equipment item number data field include data pertaining to identifiers for identifying the model and the equipment item number of the MFP 10 used by the customer.

The confirmation date data field includes data for identifying the date and time of confirming the usage status of the MFP 10. In the present embodiment, a monitoring device for remote-monitoring the status of the MFP 10 via the Internet records the present date and time when a fixed time report or a parts alarm is acquired.

The component code data field includes data for identifying a PM target component included in the MFP 10.

The usage length data field includes data pertaining to the usage amount of using the PM target component on a particular usage date. This usage amount is also expressed by the accumulated number of drum revolutions (length).

The accumulated length data field includes data pertaining to the accumulated amount of using the PM target component. This accumulated amount is also expressed by the accumulated number of drum revolutions (length).

The wear-out rate data field includes data pertaining to the proportion of wear out due to usage with respect to the upper-limit value indicating the upper limit to which the PM target component can be used.

The remaining number of days data field includes data pertaining to a predictive value of remaining days until the PM target component is used up to the upper-limit value.

Figure 4C:
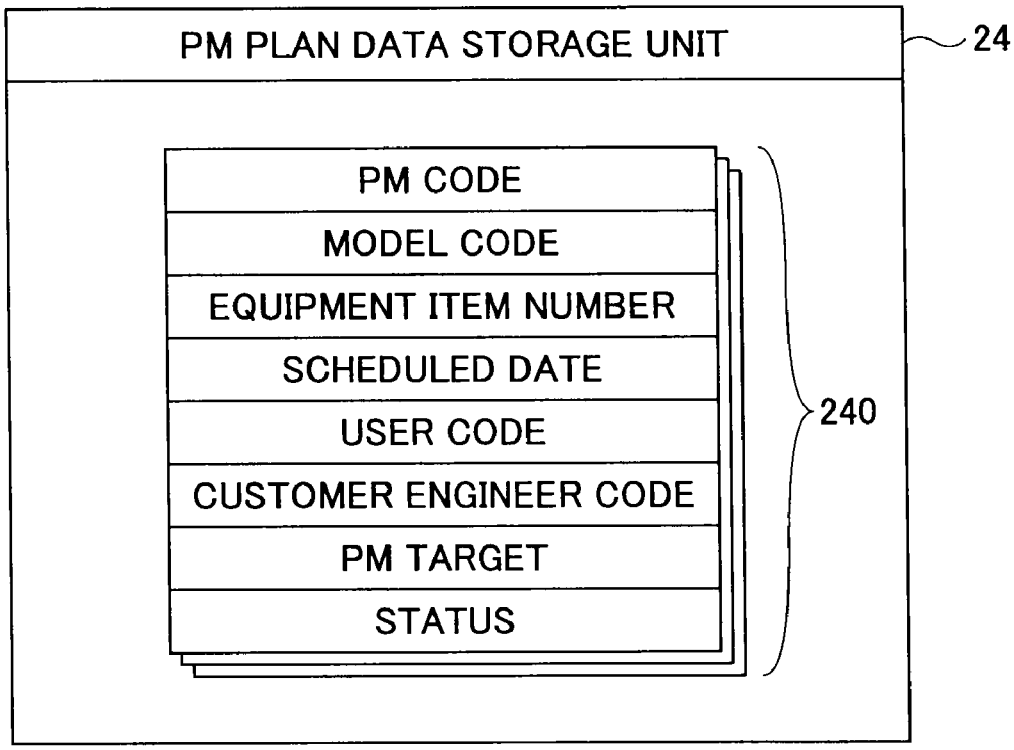

The PM plan data storage unit 24 functions as a maintenance plan information storage unit. As shown in FIG. 4C, the PM plan data storage unit 24 includes PM plan data 240 for identifying a target device for which preventive maintenance is to be performed in a particular month. The PM plan data 240 are recorded when a new parts alarm is received. The PM plan data 240 function as maintenance plan information, and include data pertaining to a PM code, a model code, an equipment item number, a scheduled date, a user code, a customer engineer code, a PM target, and a status.

The PM code data field includes data pertaining to an identifier for identifying each preventive maintenance operation of a particular month.

The model code data field and the equipment item number data field include data pertaining to an identifier for identifying the model and the equipment item number of the MFP 10 that is a target of preventive maintenance in a particular month.

The scheduled date data field includes data pertaining to a scheduled date for performing the current preventive maintenance.

The user code data field includes data pertaining to an identifier for identifying a customer using the MFP 10.

The customer engineer code data field includes data pertaining to an identifier for identifying the customer engineer for executing preventive maintenance, who is also in charge of the customer account.

The PM target data field includes data pertaining to an identifier for identifying a component to be a target of a current maintenance operation.

The status data field includes data for identifying whether there is an order placed for a replacement component used in this maintenance operation. Specifically, when an order process is performed for a replacement component, an "order placed" flag is recorded in this data field.

Figure 4D:
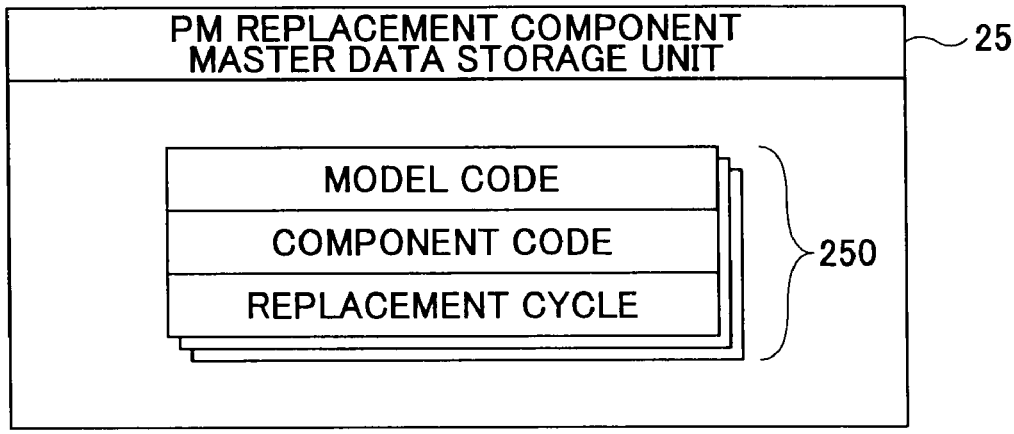

As shown in FIG. 4D, the PM replacement component master data storage unit 25 includes PM replacement component master data 250 for identifying components that are to be targets in performing preventive maintenance for each of the models of the MFP 10. The PM replacement component master data 250 are recorded when a replacement cycle for each component included in the MFP 10 is determined and registered. The PM replacement component master data 250 include data pertaining to a model code, a component code, and a replacement cycle.

The model code data field includes data pertaining to an identifier for identifying the model of the MFP 10 that is a target of preventive maintenance.

The component code data field includes data pertaining to a component identifier for identifying a component included in the MFP 10 that is a target of replacement in preventive maintenance.

The replacement cycle data field includes data pertaining to an amount for identifying the cycle of replacing the component (replacement cycle amount). For example, in the case of a multifunction peripheral, data pertaining to the number of remaining days (remainder day reference value, addition reference value) for identifying the timing of replacement are recorded.

Figure 5A:
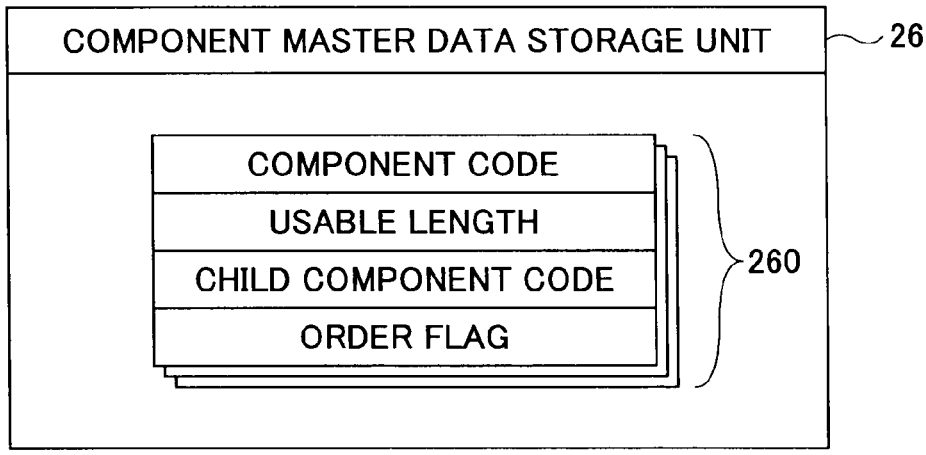
FIGS. 5A and 5B illustrate data storage units in the maintenance management server, where

The component master data storage unit 26 functions as a component related information storage unit. As shown in FIG. 5A, the component master data storage unit 26 includes component master data 260 for identifying the attributes of each component. The component master data 260 are recorded when each component is registered. The component master data 260 include data pertaining to a usable length, a child component code, and an order flag with respect to a component code.

The component code data field includes data pertaining to an identifier for identifying each component.

The usable length data field includes data pertaining to an upper-limit value indicating the upper limit to which the PM target component can be used. This upper-limit value is expressed by the accumulated number of drum revolutions (length).

The child component code data field includes data pertaining to an identifier for identifying a child component (including grandchild component, great-grandchild component, etc.) included in each component. Accordingly, it is possible to determine the parent-child relationship of parent components including child components.

The order flag data field includes data pertaining to an identifier for determining whether automatic ordering is possible for the component. When the order flag is specifying "automatic", the component order data are registered. When there is no specification of "automatic", only a PM plan is created.

Figure 5B:
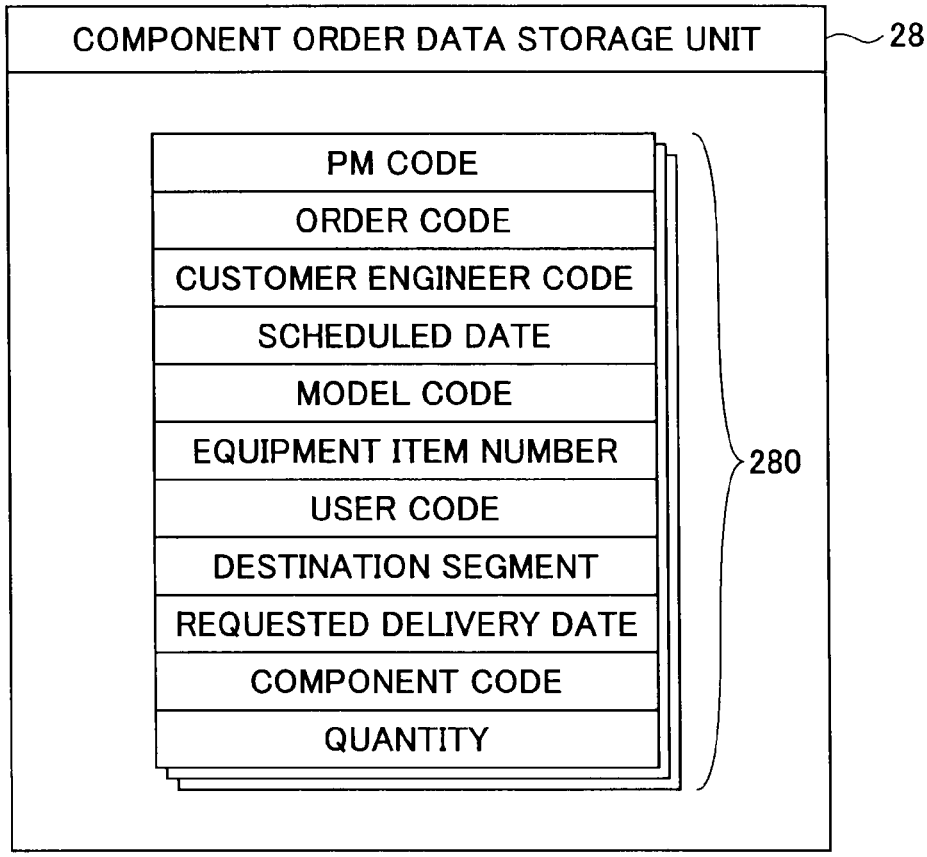

As shown in FIG. 5B, the component order data storage unit 28 includes component order data 280 pertaining to ordering components used for performing preventive maintenance. The component order data 280 are recorded when a component is ordered. The component order data 280 include data pertaining to a PM code, an order code, a customer engineer code, a scheduled date, a model code, an equipment item number, a user code, a destination segment, a requested delivery date, a component code, and quantity.

The PM code data field includes data pertaining to an identifier for identifying the preventive maintenance.

The order code data field includes data pertaining to an identifier for identifying an ordered replacement component in the preventive maintenance.

The customer engineer code data field includes data pertaining to an identifier for identifying the customer engineer for performing the preventive maintenance.

The scheduled date data field includes data pertaining to a scheduled date for performing the maintenance.

The model code data field and the equipment item number data field include data pertaining to the model and the equipment item number for identifying the MFP 10 that is a target of preventive maintenance.

The user code data field includes data pertaining to an identifier for identifying the customer using the MFP 10.

The destination segment data field includes data pertaining to the delivery destination of the PM kit. In the present embodiment, a service station (SS) at which the customer engineer is stationed or a user's location where the MFP 10 is installed is selected as the delivery destination segment.

The component code data field includes data pertaining to an ordered replacement component.

The quantity data field includes data pertaining to the quantity of the ordered replacement component.

The customer engineer terminal 30 is a computer terminal used by a customer engineer, and includes a control unit (CPU), storage units (RAM, ROM, etc.), an input unit (keyboard and pointing device), an output unit (display), and a communications unit. The customer engineer terminal 30 is used for setting a visiting date for maintenance in a PM plan, setting the necessary quantity of components, and placing additional orders.

The component order server 40 acquires the component order data 280 recorded in the component order data storage unit 28, and sends an instruction to prepare a PM kit to a supplier.

Next, a description is given of a process of placing orders for replacement components with the use of the above system. Here, a description is given of a usage status monitoring process and an order setting process.

(Usage Status Monitoring Process)

Figure 6:
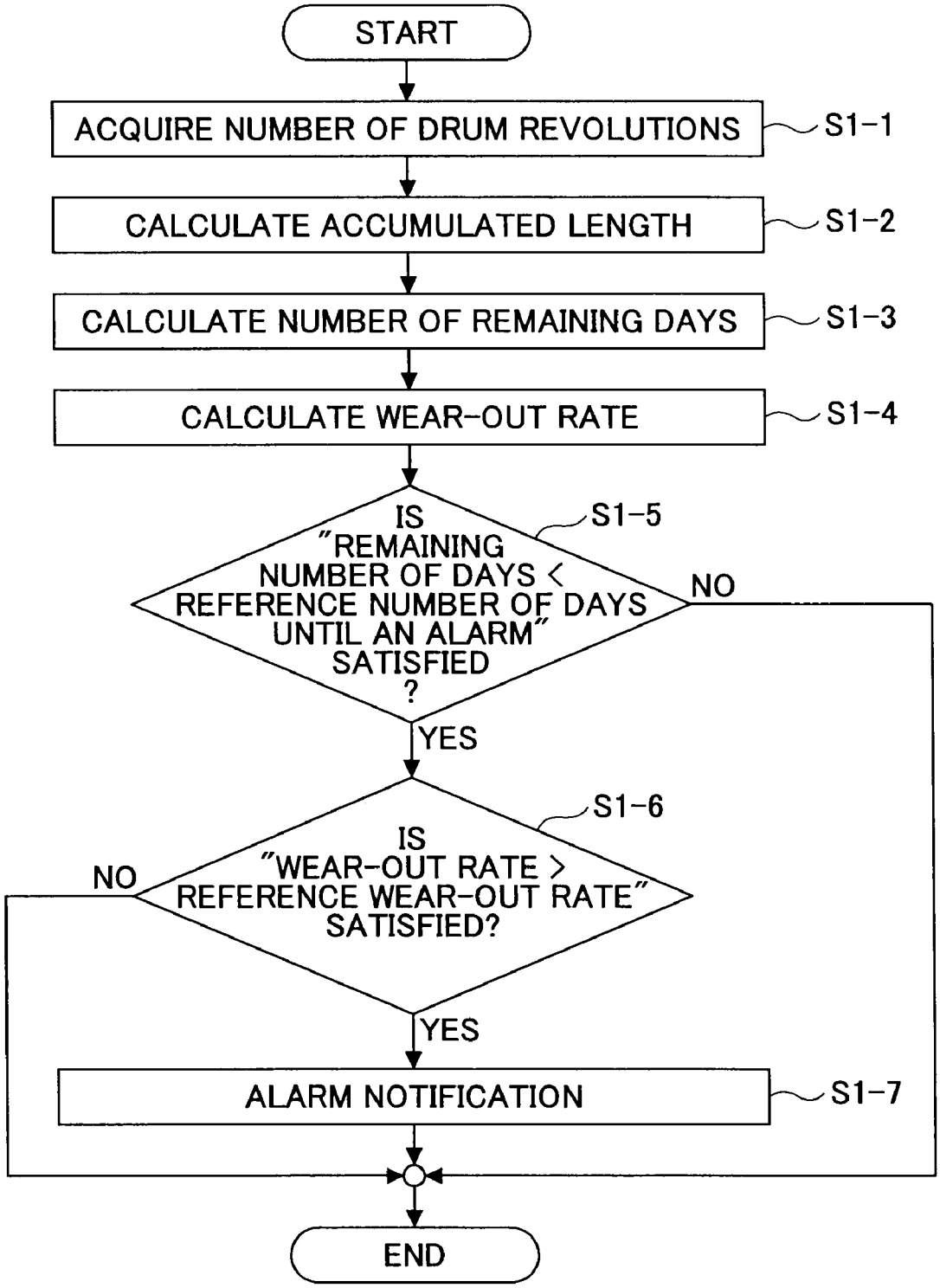
FIG. 6 is a flowchart of a process according to an embodiment of the present invention.

First, with reference to FIG. 6, a description is given of a usage status monitoring process performed by the MFP 10. Conventionally, for replacement components of the MFP 10, the PM reference defines the service life by the number of output sheets. However, in an embodiment of the present invention, the PM reference corresponds to the number of revolutions (length) of the drum, so that the PM reference of each component is expressed by a length. In the MFP 10, every time a copying or printing operation is performed (for each output job), the number of revolutions (length) is acquired for each photoconductive drum, the service life of each component is calculated, which is saved as a number of remaining days and a wear-out rate. When the result obtained by this calculation performed for each output job indicates that the number of remaining days is less than or equal to a threshold that is previously set in the image forming apparatus, a notification is sent to the maintenance management server 20 (parts alarm call) via the Internet. The specific process is described below.

The control unit 11 of the MFP 10 executes a process for acquiring the number of revolutions of the drum (step S1-1). Specifically, when the sensor system 101 of the MFP 10 detects that a job has been executed, the sensor system 101 acquires, from the output processing unit 100, information pertaining to the number of revolutions of the drum. The revolution number information acquiring unit 11*a* of the control unit 11 acquires revolution number information from the sensor system 101. In this case, the revolution number information acquiring unit 11*a* acquires revolution number information from each of the photoconductive drums (drums of YMCK). The revolution number information acquiring unit 11*a* adds the revolution number to the usage length on the usage date in the PM target component data storage unit 12, in association with a component code corresponding to each photoconductive drum.

Next, the control unit 11 of the MFP 10 executes a calculation process to calculate the accumulated length (step S1-2). Specifically, the revolution number information acquiring unit 11*a* of the control unit 11 adds the acquired revolution number to an accumulated length recorded in the PM target component data storage unit 12 in association with a component code corresponding to each photoconductive drum.

Next, the control unit 11 of the MFP 10 executes a calculation process to calculate the number of remaining days (step S1-3). Specifically, the usage status management unit 11*b* of the control unit 11 calculates the remaining length by subtracting the accumulated length from the usable length recorded in the PM target component data storage unit 12. Furthermore, the usage status management unit 11*b* calculates the average usage length per day by using the usage lengths for each of the usage dates recorded in the PM target component data storage unit 12. The usage status management unit 11*b* calculates the number of remaining days by dividing the remaining length by the average usage length per day, and records the number of remaining days in the PM target component data storage unit 12.

Next, the control unit 11 of the MFP 10 executes a calculating/recording process for calculating/recording the wear-out rate (step S1-4). Specifically, the usage status management unit 11*b* of the control unit 11 calculates the wear-out rate by dividing the accumulated length by the usable length, and records the wear-out rate in the PM target component data storage unit 12.

Next, the control unit 11 of the MFP 10 executes a comparison process for comparing the remaining number of days and the reference number of days until an alarm (step S1-5). Specifically, the notification determination unit 11*c* of the control unit 11 compares the calculated remaining number of days and the reference number of days until an alarm (for example, 15 days) recorded in the notification reference data storage unit 14. When the remaining number of days is more than the reference number of days until an alarm ("No" in step S1-5), the notification determination unit 11*c* of the control unit 11 ends the usage status monitoring process.

On the other hand, when the remaining number of days is less than the reference number of days until an alarm ("Yes" in step S1-5), the control unit 11 of the MFP 10 executes a comparison process to compare the wear-out rate and the reference value (step S1-6). Specifically, the notification determination unit 11*c* of the control unit 11 compares the wear-out rate and the reference wear-out rate recorded in the notification reference data storage unit 14. When the wear-out rate is less than the reference wear-out rate ("No" in step S1-6), the notification determination unit 11*c* of the control unit 11 ends the usage status monitoring process. On the other hand, when the wear-out rate is more than the reference wear-out rate ("Yes" in step S1-6), the control unit 11 of the MFP 10 executes an alarm notification process (step S1-7). Specifically, the notification determination unit 11*c* of the control unit 11 sends a parts alarm to the maintenance management server 20 via the Internet. The parts alarm includes data pertaining to a model code, an equipment item number, and a component code.

(Order Setting Process)

Figure 7:
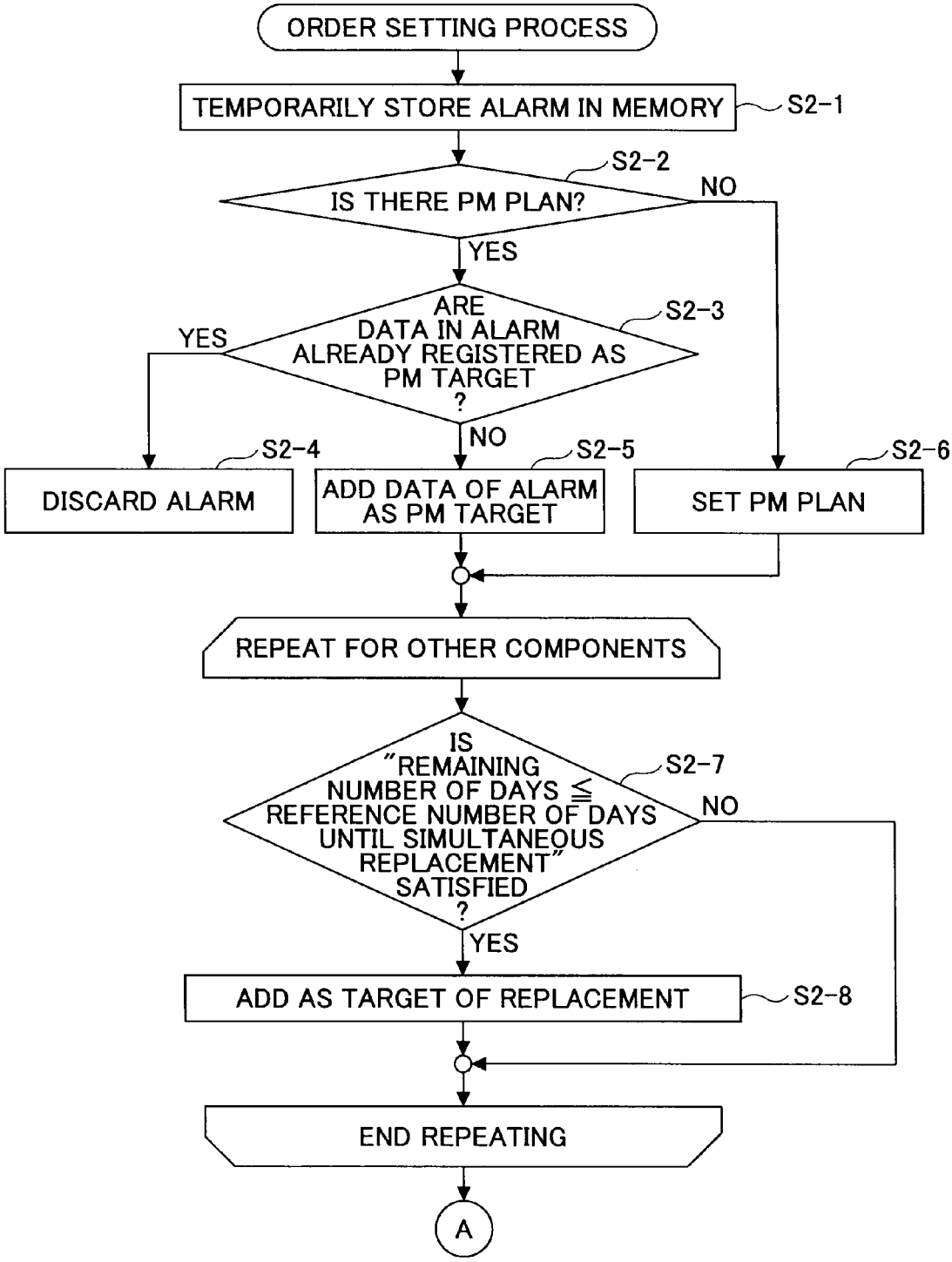
FIG. 7 is a flowchart of another process according to an embodiment of the present invention.
Figure 8:
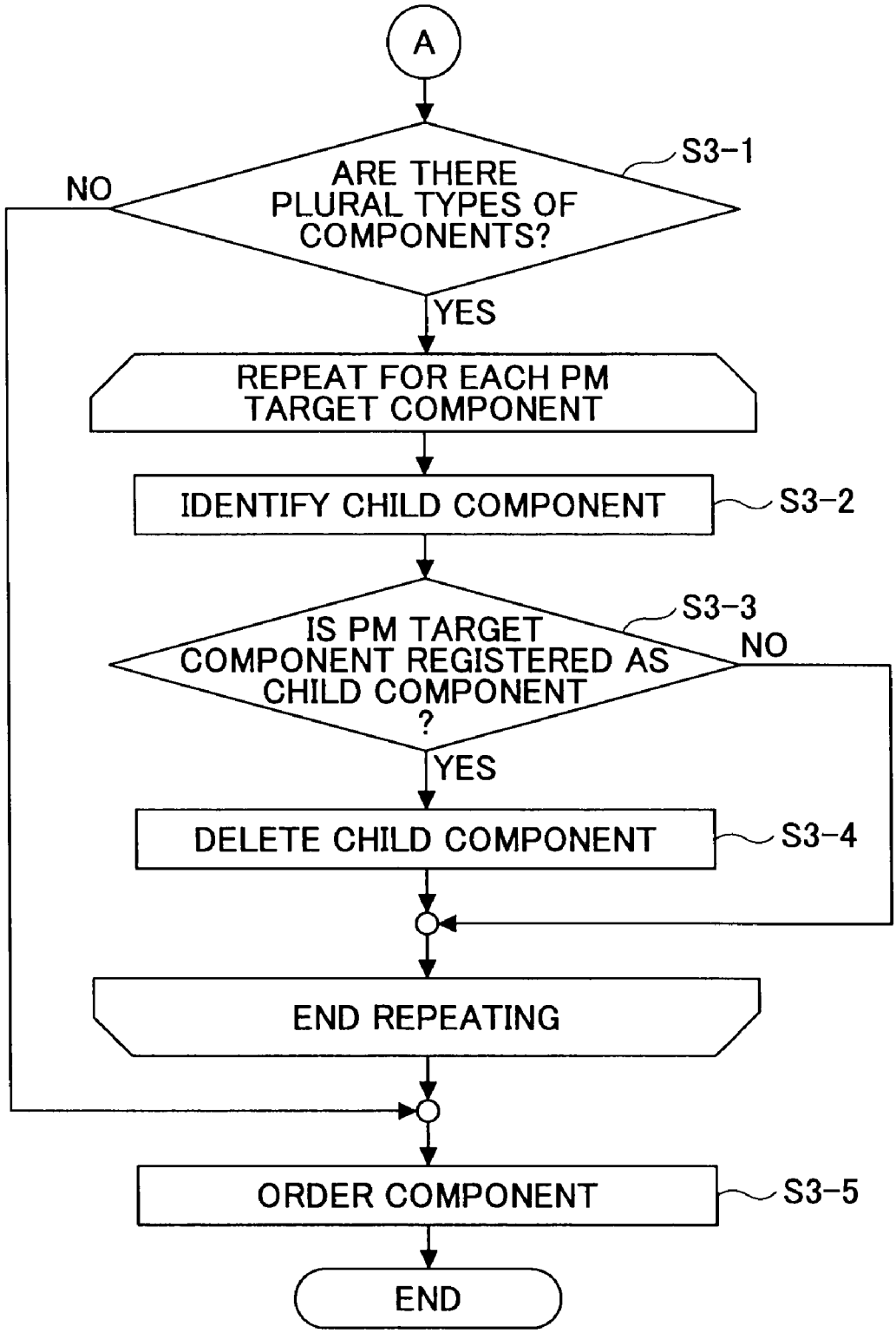
FIG. 8 is a flowchart of the other process continued from FIG. 7 according to an embodiment of the present invention.

Next, with reference to FIGS. 7 and 8, a description is given of an order setting process performed by the maintenance management server 20. The control unit 21 of the maintenance management server 20 that has received the parts alarm executes a memory temporary storage process (step S2-1). Specifically, the notification registration unit 21*a* of the control unit 21 temporarily stores, in a memory, the parts alarm acquired from the MFP 10.

Next, the control unit 21 of the maintenance management server 20 executes a confirmation process to confirm whether there is a PM plan (step S2-2). Specifically, the PM plan management unit 21*b* of the control unit 21 confirms whether the PM plan data 240 pertaining to the model code and the equipment item number included in the parts alarm are registered in the PM plan data storage unit 24. When the PM plan data 240 are already registered ("Yes" in step S2-2), the control unit 21 of the maintenance management server 20 executes a confirmation process for confirming whether there is a PM target (step S2-3). Specifically, the PM plan management unit 21*b* of the control unit 21 confirms whether the component code included in the parts alarm is registered as a PM target in the PM plan data 240. When the component code included in the parts alarm is a PM target ("Yes" in step S2-3), the PM plan management unit 21*b* of the control unit 21 discards the parts alarm (step S2-4).

On the other hand, when the component code included in the parts alarm is not a PM target ("No" in step S2-3), the control unit 21 of the maintenance management server 20 executes an addition process for the PM target (step S2-5). Specifically, the PM plan management unit 21*b* of the control unit 21 adds the component code included in the parts alarm as a PM target to the PM plan data 240 recorded in the PM plan data storage unit 24.

On the other hand, when the PM plan data 240 pertaining to the model code and the equipment item number included in the parts alarm are not registered in the PM plan data storage unit 24 ("No" in step S2-2), the control unit 21 of the maintenance management server 20 executes a setting process for a PM plan (step S2-6). Specifically, the PM plan management unit 21*b* of the control unit 21 generates new PM plan data 240 including the component code included in the parts alarm. In this case, the PM plan management unit 21*b* allocates a PM code, and generates the PM plan data 240 including the user code, the model code, the equipment item number, and the customer engineer code with the use of the device file data 220 recorded in the device file data storage unit 22. Then, the PM plan management unit 21*b* registers the PM plan data 240 in the PM plan data storage unit 24.

Next, the control unit 21 of the maintenance management server 20 searches for a component to be simultaneously replaced among other components of this model code and equipment item number. Specifically, the control unit 21 of the maintenance management server 20 executes a comparison process for comparing the remaining number of days and a reference number of days until simultaneous replacement (step S2-7). More specifically, the simultaneous replacement component registration unit 21*c* of the control unit 21 acquires the reference number of days until simultaneous replacement (addition reference value) stored in a reference data storage unit (not shown). The simultaneous replacement component registration unit 21*c* searches for a component having this model code and equipment item number, whose remaining number of days in the output history data 230 of the latest confirmation date is less than or equal to the reference number of days until simultaneous replacement (for example, 45 days). When the simultaneous replacement component registration unit 21*c* finds a component, which has a remaining number of days that is less than or equal to the reference number of days until simultaneous replacement ("Yes" in step S2-7), the control unit 21 of the maintenance management server 20 executes an addition process for adding a replacement target (step S2-8). Specifically, the simultaneous replacement component registration unit 21*c* of the control unit 21 additionally records this component as a PM target in the PM plan data 240. The above process is repeated for each of the other components recorded in the output history data 230.

Next, as shown in FIG. 8, the control unit 21 of the maintenance management server 20 executes a confirmation process for confirming the number of types of PM targets recorded in the PM plan data 240 (step S3-1). When one type of component is the target of maintenance ("No" in step S3-1), the control unit 21 executes the parts order process described below (step S3-5).

On the other hand, when plural types of components are targets of maintenance ("Yes" in step S3-1), the control unit 21 of the maintenance management server 20 repeats the process below for each of the PM target components.

The control unit 21 of the maintenance management server 20 executes an identification process for identifying a child component (step S3-2). Specifically, the parent-child component confirmation unit 21*d* of the control unit 21 checks the component master data storage unit 26, and identifies a child component (including grandchild component, great-grandchild component, etc.).

The control unit 21 of the maintenance management server 20 executes a registration confirmation process for a child component (step S3-3). Specifically, the parent-child component confirmation unit 21*d* of the control unit 21 confirms whether other components recorded as PM targets in the PM plan data 240 are registered as child components. When another component recorded as a PM target in the PM plan data 240 is registered as a child component ("Yes" in step S3-3), the control unit 21 of the maintenance management server 20 executes a deleting process of deleting this child component (step S3-4). Specifically, the parent-child component confirmation unit 21*d* of the control unit 21 deletes the component code of this child component from the PM targets in the PM plan data 240. The above process is repeated for each of the other PM target components.

The control unit 21 of the maintenance management server 20 executes a parts order process (step S3-5). Specifically, when an order flag is specifying "automatic" in the component master data storage unit 26, the component order registration unit 21*e* of the control unit 21 registers, in the component order data storage unit 28, the PM targets recorded in the PM plan data storage unit 24. The component order registration unit 21*e* allocates order codes, and generates component order data 280 with the use of various data elements (PM code, model code, equipment item number, scheduled date, user code, customer engineer code, etc.) recorded in the PM plan data 240. In the present embodiment, the requested delivery date is automatically set at a predetermined time before the scheduled date.

The component order server 40 acquires the component order data 280 recorded in the component order data storage unit 28, and sends an instruction to prepare a PM kit to the supplier. This preparation instruction includes data pertaining to the component order data 280. In this case, the component order server 40 acquires delivery destination information from a customer information storage unit and a sales office information storage unit based on a destination segment and a user code included in the component order data 280. The component order server 40 determines an appointed delivery date based on the scheduled date and the requested delivery date included in the component order data 280. The supplier creates a PM kit in which a specified quantity of components is put together in a package. The supplier delivers this PM kit to a delivery destination specified in the component order data 280 on an appointed delivery date.

According to the above-described embodiment, the following effects can be achieved.

In the above embodiment, the number of rotations of a photoconductive drum is used as a reference for determining replacement components for maintenance. When the image forming apparatus is a color machine, there are components that are used and components that are not used for one output operation. Thus, the usage status cannot be accurately identified based on the number of output sheets. According to an embodiment of the present invention, the usage status can be accurately determined based on the accumulated number of revolutions (length) of each photoconductive drum.

In the above embodiment, the MFP 10 executes a usage status monitoring process for each job. When the value exceeds a reference value recorded in the notification reference data storage unit 14, the control unit 11 of the MFP 10 executes an alarm notification process (step S1-7). The image forming apparatus confirms the usage status based on the remaining number of days and the wear-out rate. Therefore, the parts alarm is sent in a timely manner. As a result, maintenance can be quickly performed.

In the above embodiment, the control unit 11 of the MFP 10 executes a comparison process for comparing the remaining number of days with the reference number of days until an alarm (step S1-5). When the remaining number of days is less than the reference number of days ("Yes" in step S1-5), the control unit 11 of the MFP 10 executes a comparison process for comparing the wear-out rate and the reference value (step S1-6). For example, it is assumed that the remaining number of days for a particular component is 50 days. Usually, only about several dozens of sheets are output per day. However, if a large number of sheets (for example, 1,000 sheets) is output for a special occasion, the calculated remaining number of days for the component will sharply decrease, to less than 15 days, for example. At this point, a parts alarm is generated. However, if the number of output sheets returns to the usual several dozens of sheets on the next day, the remaining number of days may increase once again ("rewinding phenomenon"). In the present embodiment, the wear-out rate is also used in order to mitigate such a rewinding phenomenon.

In the above embodiment, the control unit 21 of the maintenance management server 20 executes a confirmation process for confirming whether there is a PM plan (step S2-2). When the PM plan data 240 are already registered ("Yes" in step S2-2), the control unit 21 of the maintenance management server 20 executes a confirmation process for confirming whether there is a PM target (step S2-3). When the component code included in the parts alarm is a PM target ("Yes" in step S2-3), the PM plan management unit 21*b* of the control unit 21 discards the parts alarm (step S2-4). Accordingly, it is possible to prevent redundant maintenance operations from being registered.

In the above embodiment, the control unit 21 of the maintenance management server 20 executes a comparison process for comparing the remaining number of days and a reference number of days until simultaneous replacement (step S2-7). When the simultaneous replacement component registration unit 21*c* finds a component, which has a remaining number of days that is less than or equal to the reference number of days until simultaneous replacement ("Yes" in step S2-7), the control unit 21 of the maintenance management server 20 executes an addition process for adding a replacement target (step S2-8). Accordingly, a component with a small number of remaining days can also be replaced simultaneously, so that maintenance can be efficiently performed.

In the above embodiment, when plural types of components are targets of maintenance ("Yes" in step S3-1), the control unit 21 of the maintenance management server 20 executes an identification process for identifying a child component (step S3-2). When another component recorded as a PM target in the PM plan data 240 is registered as a child component ("Yes" in step S3-3), the control unit 21 of the maintenance management server 20 executes a deleting process for deleting this child component (step S3-4). Accordingly, when a parent component is replaced, it is not necessary to replace a child component included in this parent component, and therefore, it is possible to prevent unnecessary components from being ordered.

The above embodiment can be modified as below.

In the above embodiment, the MFP 10 acts as the image forming apparatus. However, the image forming apparatus including a photoconductive drum is not limited thereto.

In the above embodiment, the MFP 10 and the maintenance management server 20 are interconnected via the Internet. However, the network is not limited to the Internet; a public line network can be used.

In the above embodiment, the confirmation process for a simultaneous replacement component is performed by the maintenance management server 20. Alternatively, this process can be performed by the MFP 10. In this case, the control unit 11 of the MFP 10 executes a confirmation process for a simultaneous replacement component before sending a parts alarm. When the simultaneous replacement component registration unit 21*c* finds a component, which has a remaining number of days that is less than or equal to the reference number of days until simultaneous replacement, this is included in the parts alarm.

In the above embodiment, when the wear-out rate is more than the reference wear-out rate ("Yes" in step S1-6), the control unit 11 of the MFP 10 executes an alarm notification process (step S1-7). Another method can be performed for mitigating the rewinding phenomenon. For example, when the remaining number of days is less than the reference number of days until an alarm ("Yes" in step S1-5), changes in the remaining number of days are monitored. When this remaining number of days continues for more than a certain period of time, the parts alarm is sent.

According to one embodiment of the present invention, a maintenance management system includes an upper-limit information storage unit configured to store an upper limit of usage for each component identifier of a component, which upper-limit is expressed by using an accumulated number of revolutions of a photoconductive drum in an image forming apparatus; a revolution number information acquiring unit configured to acquire a number of revolutions of the photoconductive drum used in the image forming apparatus; and an alarm output unit configured to calculate the accumulated number of revolutions of the used photoconductive drum, calculate a component service life predictive value by using the upper limit stored in the upper-limit information storage unit for each component identifier, and output an alarm including component information pertaining to the corresponding component identifier in the event that the component service life predictive value is less than or equal to a remainder day reference value.

Additionally, the maintenance management system further includes a wear-out rate reference information storage unit configured to store, for each component identifier, a reference wear-out rate with respect to the upper limit of the number of revolutions of the photoconductive drum, wherein the alarm output unit calculates a wear-out rate by using the calculated accumulated number of revolutions and the upper-limit, and outputs the alarm in the event that the wear-out rate exceeds the reference wear-out rate stored in the wear-out rate reference information storage unit.

Additionally, in the maintenance management system, the alarm output unit executes an alarm necessity determination process for determining whether output of the alarm is necessary for each output job.

Additionally, the maintenance management system further includes a maintenance plan information storage unit configured to store a maintenance plan including the component information of maintenance target components; and a maintenance plan management unit configured to additionally record, in the maintenance plan information storage unit, a maintenance plan pertaining to a certain component in the event that the component identifier of the certain component included in the alarm is not recorded in the maintenance plan stored in the maintenance plan information storage unit.

Additionally, in the maintenance management system, in the event of additionally recording the maintenance plan pertaining to the certain component in the maintenance plan information storage unit, the maintenance plan management unit calculates the component service life predictive values for other components included in the image forming apparatus based on the accumulated number of revolutions of the photoconductive drum, and additionally records, in the maintenance plan as a simultaneous replacement component, any of the other components for which the component service life predictive value is less than or equal to an addition reference value.

Additionally, the maintenance management system further includes a component relationship information storage unit configured to store, for components included in the image forming apparatus, component identifiers of parent components including child components, wherein the maintenance plan management unit identifies parent-child relationships of the components included in the maintenance plan stored in the maintenance plan information storage unit by referring to the component relationship information storage unit, and in the event that a parent component and a child component having a parent-child relationship are registered as the maintenance target components, the maintenance plan management unit deletes the component identifier of the child component from the maintenance plan.

According to one embodiment of the present invention, an image forming apparatus includes a photoconductive drum configured to form images; a detection unit configured to detect a number of revolutions of the photoconductive drum; an upper-limit information storage unit configured to store an upper limit of usage for each component identifier of a component, which upper limit is expressed by using an accumulated number of revolutions of the photoconductive drum in the image forming apparatus; and an alarm output unit configured to calculate the accumulated number of revolutions of the used photoconductive drum, calculate a component service life predictive value by using the upper limit stored in the upper-limit information storage unit for each component identifier, and output an alarm including component information pertaining to the corresponding component identifier in the event that the component service life predictive value is less than or equal to a remainder day reference value.

Additionally, the image forming apparatus further includes a wear-out rate reference information storage unit configured to store, for each component identifier, a reference wear-out rate with respect to the upper limit of the number of revolutions of the photoconductive drum, wherein the alarm output unit calculates a wear-out rate by using the calculated accumulated number of revolutions and the upper limit, and outputs the alarm in the event that the wear-out rate exceeds the reference wear-out rate stored in the wear-out rate reference information storage unit.

Additionally, in the image forming apparatus, the alarm output unit executes an alarm necessity determination process for determining whether output of the alarm is necessary for each output job.

According to one embodiment of the present invention, a maintenance management system includes an upper-limit information storage unit configured to store an upper-limit of usage for each component identifier of a component, which upper-limit is expressed by using an accumulated number of revolutions of a photoconductive drum in an image forming apparatus. A number of revolutions of the photoconductive drum used in the image forming apparatus is acquired. Next, the accumulated number of revolutions of the used photoconductive drum is calculated, a component service life predictive value is calculated by using the upper-limit stored in the upper-limit information storage unit for each component identifier, and an alarm including component information pertaining to the corresponding component identifier is output in the event that the component service life predictive value is less than or equal to a remainder day reference value. Accordingly, the component service life can be accurately predicted even in a color machine, and a precise maintenance plan can be created.

According to one embodiment of the present invention, the maintenance management system further includes a wear-out rate reference information storage unit configured to store, for each component identifier, a reference wear-out rate with respect to the upper-limit of the number of revolutions of the photoconductive drum. The alarm output unit calculates a wear-out rate by using the calculated accumulated number of revolutions and the upper-limit, and outputs the alarm in the event that the wear-out rate exceeds the reference wear-out rate stored in the wear-out rate reference information storage unit. When the usage amount temporarily increases, the calculated component service life predictive value decreases. However, when the usage status becomes normal once again, the calculated component service life predictive value increases once again. This is referred to as a "rewinding phenomenon". Even when such a "rewinding phenomenon" occurs, maintenance can be accurately performed with the above configuration.

According to one embodiment of the present invention, in the maintenance management system, the alarm output unit executes an alarm necessity determination process for determining whether output of the alarm is necessary for each output job. Accordingly, the usage status of components can be monitored in a substantially real-time manner.

According to one embodiment of the present invention, the maintenance management system further includes a maintenance plan information storage unit configured to store a maintenance plan including the component information of maintenance target components. A maintenance plan pertaining to a certain component is additionally recorded in the maintenance plan information storage unit, in the event that the component identifier of the certain component included in the alarm is not recorded in the maintenance plan stored in the maintenance plan information storage unit. Accordingly, a maintenance plan can be created in accordance with the alarm.

According to one embodiment of the present invention, in the maintenance management system, in the event of additionally recording the maintenance plan pertaining to the certain component in the maintenance plan information storage unit, the maintenance plan management unit calculates the component service life predictive values for other components included in the image forming apparatus based on the accumulated number of revolutions of the photoconductive drum. Furthermore, the maintenance plan management unit additionally records, in the maintenance plan as a simultaneous replacement component, any of the other components for which the component service life predictive value is less than or equal to an addition reference value. Accordingly, a component whose service life has decreased can be efficiently replaced.

According to one embodiment of the present invention, the maintenance management system further includes a component relationship information storage unit configured to store, for components included in the image forming apparatus, component identifiers of parent components including child components. The maintenance plan management unit identifies parent-child relationships of the components included in the maintenance plan stored in the maintenance plan information storage unit by referring to the component relationship information storage unit, and in the event that a parent component and a child component having a parent-child relationship are registered as the maintenance target components, the maintenance plan management unit deletes the component identifier of the child component from the maintenance plan. Accordingly, when there are components having a parent-child relationship combined in a single unit, it is possible to prevent the same component from being redundantly ordered, or to prevent an unnecessary component from being ordered and replaced.

According to one embodiment of the present invention, in an image forming apparatus, it is determined whether it is necessary to output an alarm. Accordingly, alarms can be output in a timely manner while reducing the communication load.

The present invention is not limited to the specifically disclosed embodiment, and variations and modifications may be made without departing from the scope of the present invention.

The present application is based on Japanese Priority Patent Application No. 2007-157617, filed on Jun. 14, 2007, the entire contents of which are hereby incorporated herein by reference.

What is claimed is:

1. A maintenance management system comprising:

an upper-limit information storage unit configured to store an upper limit of usage of at least one component identifier of a component, which upper-limit is expressed by using an accumulated number of revolutions of a photoconductive drum in an image forming apparatus;

a revolution number information acquiring unit configured to acquire a number of revolutions of the photoconductive drum used in the image forming apparatus;

an alarm output unit configured to calculate the accumulated number of revolutions of the photoconductive drum, calculate a component service life predictive value by using the upper limit stored in the upper-limit information storage unit for each of the at least one component identifier, and output an alarm comprising component information pertaining to the corresponding component identifier in the event that the component service life predictive value is less than or equal to a remainder day reference value; and a controller which determines the remainder day reference value by determining an average usage length day for each of the at least one component identifier, and dividing the component service life predictive value by the average usage length per day.

2. The maintenance management system according to claim 1, further comprising:

a wear-out rate reference information storage unit configured to store, for each of the at least one component identifier, a reference wear-out rate with respect to the upper limit of the number of revolutions of the photoconductive drum, wherein:

the alarm output unit calculates a wear-out rate by using the calculated accumulated number of revolutions and the upper-limit, and outputs the alarm in the event that the wear-out rate exceeds the reference wear-out rate stored in the wear-out rate reference information storage unit.

3. The maintenance management system according to claim 1, wherein:

the alarm output unit executes an alarm necessity determination process for determining whether output of the alarm is necessary for each output job.

4. The maintenance management system according to claim 1, further comprising:

a maintenance plan information storage unit configured to store a maintenance plan comprising the component information of maintenance target components; and a maintenance plan management unit configured to additionally record, in the maintenance plan information storage unit, a maintenance plan pertaining to a certain component in the event that the component identifier of the certain component included in the alarm is not recorded in the maintenance plan stored in the maintenance plan information storage unit.

5. The maintenance management system according to claim 4, wherein:

in the event of additionally recording the maintenance plan pertaining to the certain component in the maintenance plan information storage unit, the maintenance plan management unit calculates the component service life predictive values for other components included in the image forming apparatus based on the accumulated number of revolutions of the photoconductive drum, and additionally records, in the maintenance plan as a simultaneous replacement component, any of the other components for which the component service life predictive value is less than or equal to an addition reference value.

6. The maintenance management system according to claim 4, further comprising:

a component relationship information storage unit configured to store, for components included in the image forming apparatus, component identifiers of parent components including child components, wherein:

the maintenance plan management unit identifies parent-child relationships of the components included in the maintenance plan stored in the maintenance plan information storage unit by referring to the component relationship information storage unit, and in the event that a parent component and a child component having a parent-child relationship are registered as the maintenance target components, the maintenance plan management unit deletes the component identifier of the child component from the maintenance plan.

7. An image forming apparatus comprising:

a photoconductive drum configured to form images;

a detection unit configured to detect a number of revolutions of the photoconductive drum;

an upper-limit information storage unit configured to store an upper limit of usage of at least one component identifier of a component, which upper limit is expressed by using an accumulated number of revolutions of the photoconductive drum in the image forming apparatus; and an alarm output unit configured to calculate the accumulated number of revolutions of the photoconductive drum, calculate a component service life predictive value by using the upper limit stored in the upper-limit information storage unit for each of the at least one component identifier, and output an alarm comprising component information pertaining to the corresponding component identifier in the event that the component service life predictive value is less than or equal to a remainder day reference value, wherein the remainder day reference value is determined by calculating an average usage length per day for each of the at least one component identifier, and dividing the component service life predictive value by the average usage length per day.

8. The image forming apparatus according to claim 7, further comprising:

a wear-out rate reference information storage unit configured to store, for each of the at least one component identifier, a reference wear-out rate with respect to the upper limit of the number of revolutions of the photoconductive drum, wherein:

the alarm output unit calculates a wear-out rate by using the calculated accumulated number of revolutions and the upper limit, and outputs the alarm in the event that the wear-out rate exceeds the reference wear-out rate stored in the wear-out rate reference information storage unit.

9. The image forming apparatus according to claim 7, wherein:

the alarm output unit executes an alarm necessity determination process for determining whether output of the alarm is necessary for each output job.

* * * * *